US007367516B2

(12) United States Patent
Zeitner et al.

(10) Patent No.: US 7,367,516 B2
(45) Date of Patent: May 6, 2008

(54) DECONTAMINATION LIQUID SPRAYING APPLIANCE

(75) Inventors: Oliver Zeitner, Höpfingen-Waldstetten (DE); Paul Erickson, Jacksonville, FL (US)

(73) Assignee: OWR S.A., Zurich (CH)

( * ) Notice: Subject to any disclaimer, the term of this patent is extended or adjusted under 35 U.S.C. 154(b) by 170 days.

(21) Appl. No.: 11/113,754

(22) Filed: Apr. 25, 2005

(65) Prior Publication Data

US 2008/0006720 A1 Jan. 10, 2008

Related U.S. Application Data

(63) Continuation of application No. PCT/EP03/11660, filed on Oct. 21, 2003.

(30) Foreign Application Priority Data

Oct. 24, 2002 (DE) ..... 202 16 472 U

(51) Int. Cl.
*B05B 9/043* (2006.01)

(52) U.S. Cl. ..... 239/333; 239/152; 239/320; 239/373; 222/175; 222/385; 224/148.2

(58) Field of Classification Search ..... 239/88–92, 239/152, 153, 154, 302, 320, 321, 322, 337, 239/373, 569, 581.1, 581.2, 582.1, 333; 383/103; 222/401, 385, 401.15, 402.15, 222/175; 224/148.1, 148.2, 148.4; 169/33
See application file for complete search history.

(56) References Cited

U.S. PATENT DOCUMENTS 367,529 A * 8/1887 Kendall ..... 222/401
872,314 A * 11/1907 Wilson ..... 134/34
1,189,932 A * 7/1916 Garber ..... 222/402
1,806,192 A 5/1931 Collins
1,875,992 A * 9/1932 Clifford ..... 239/153
1,902,548 A * 3/1933 Fenwick, Jr. ..... 222/175
1,979,135 A * 10/1934 Altenburger et al. ..... 239/414
1,986,444 A * 1/1935 McIntosh ..... 239/367
2,019,918 A * 11/1935 Liebensperger ..... 239/74
3,135,431 A * 6/1964 Matthewson et al. ..... 222/183
4,334,839 A 6/1982 Flagg
4,537,334 A * 8/1985 Spengler et al. ..... 222/401

(Continued)

FOREIGN PATENT DOCUMENTS

DE 41 04 134 C2 10/1999

*Primary Examiner*—Steven J. Ganey
(74) *Attorney, Agent, or Firm*—Laurence A. Greenberg; Werner H. Stemer; Ralph E. Locher

(57) ABSTRACT

A decontamination liquid spraying appliance has a storage container for the receiving decontamination liquid, in particular of GD5 solution, and further has a spraying device flow-connected to the storage container. The appliance is used for the decontamination of objects contaminated by harmful substances. The storage container is a pressure container with a threaded orifice formed in it. The spraying device contains an adapter head that can be screwed in a pressure tight manner into the threaded orifice and which carries a regulating valve for regulating the quantity of the decontamination liquid to be sprayed. The spraying device further has a hand-actuated air pump that has a pump tube projecting into the pressure container and a pump piston displaceable in the pump tube through a piston rod led through the adapter head, in order to act upon the interior of the pressure container with overpressure.

9 Claims, 1 Drawing Sheet

U.S. PATENT DOCUMENTS 4,651,930 A 3/1987 Magaha, Jr.
4,881,687 A * 11/1989 Ballu ..... 239/332
4,984,742 A * 1/1991 Ellison et al. ..... 239/373
5,148,948 A 9/1992 Granville et al.
5,186,391 A 2/1993 Roueche et al.
5,335,855 A * 8/1994 Borod ..... 239/152
5,649,664 A * 7/1997 Brass et al. ..... 239/373
5,775,591 A * 7/1998 Fauci ..... 239/304
6,082,896 A * 7/2000 Pulli ..... 383/6
6,113,003 A * 9/2000 Condon ..... 239/142
6,155,497 A * 12/2000 Hudson et al. ..... 239/373
6,308,899 B1 * 10/2001 Crofford ..... 239/373
6,415,956 B1 * 7/2002 Havlovitz ..... 222/109
6,695,228 B2 * 2/2004 Odessa ..... 239/337
6,719,210 B2 * 4/2004 Clarke ..... 239/74
6,729,758 B1 * 5/2004 Carter ..... 383/103
6,752,331 B2 * 6/2004 Wu ..... 239/373
6,755,400 B2 * 6/2004 Howe ..... 261/121.1

* cited by examiner

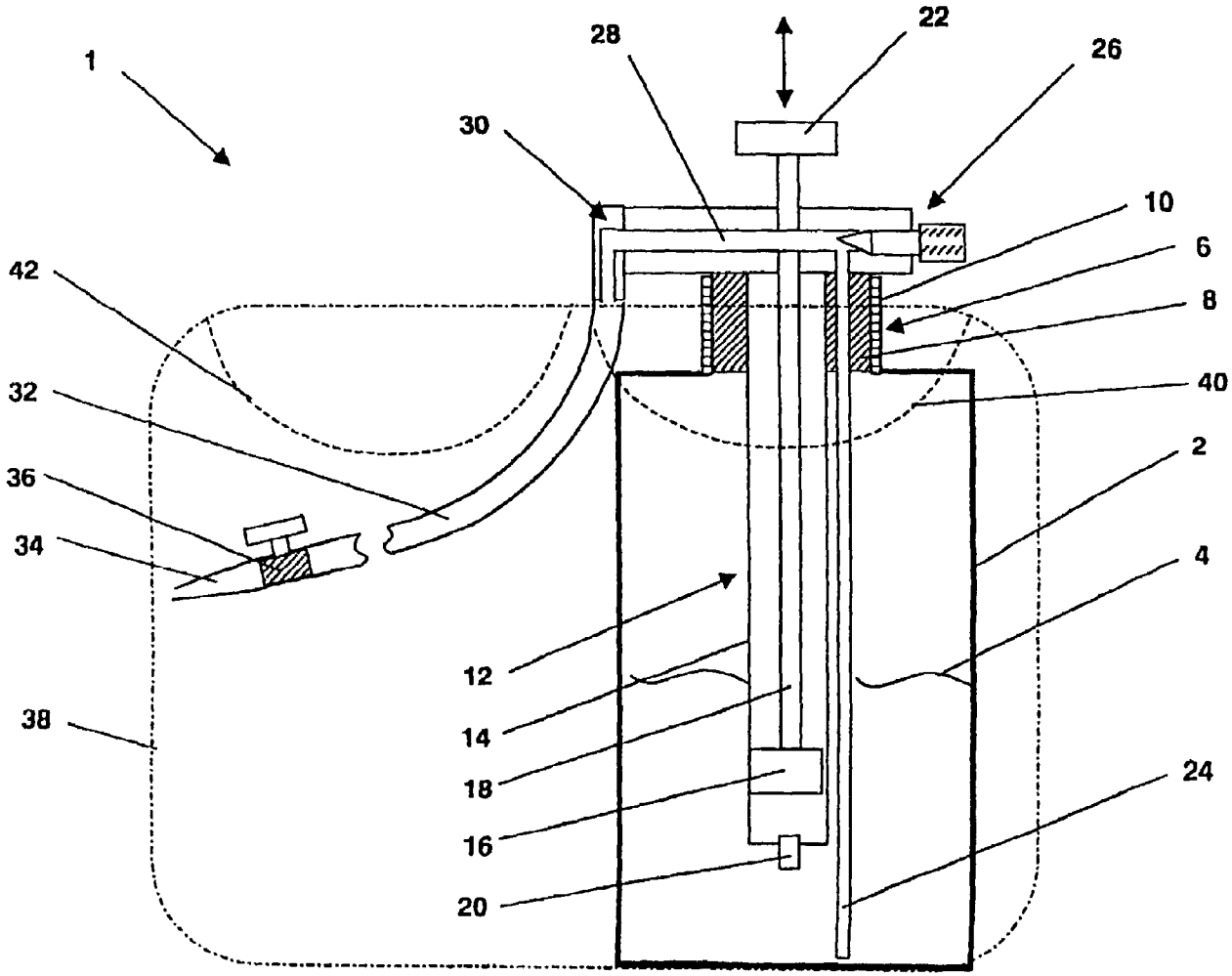
1
22
26
28
30
10
6
8
40
2
4
24
12
14
18
16
20
42
32
36
34
38

DECONTAMINATION LIQUID SPRAYING APPLIANCE

CROSS-REFERENCE TO RELATED APPLICATION

This is a continuing application, under 35 U.S.C. § 120, of copending international application No. PCT/EP2003/011660, filed Oct. 21, 2003, which designated the United States; this application also claims the priority, under 35 U.S.C. § 119, of German patent application No. 202 16 472.1, filed Oct. 24, 2002; the prior applications are herewith incorporated by reference in their entirety.

BACKGROUND OF THE INVENTION

Field of the Invention

The invention relates to a decontamination liquid spraying appliance for the spraying of objects contaminated with harmful substances with a decontamination liquid. The appliance has a storage container for receiving the decontamination liquid and a spraying device flow-connected to the storage container.

In the decontamination of objects, particularly in the military sector, which are contaminated by substances harmful to humans, such as, for example, toxic gas, radioactive particles or biological warfare agents, it is known to neutralize these by a decontamination solution sold, for example, under the designation "GD 5-solution" by the applicant.

In this regard, the decontamination solution is sprayed, for example by a spraying device, with the aid of an appliance operating according to the pulsation method, onto the object to be decontaminated, as is described, for example, in German Patent DE 41 04 134 C2. For this purpose, the device described in the publication for the application of the decontamination solution contains a combustion chamber, in which a gasoline/air mixture is ignited and the droplets of the decontamination solution are injected into the pulsating hot gas stream. The device described is complicated in technical terms and additionally requires the entrainment of liquid fuel.

Furthermore, it is known to apply the decontamination solution manually, with the aid of a rag, to the object to be decontaminated. This presents the problem that the cloth can be used only on one side, since that side of the rag which is used first and is already contaminated with harmful substances comes directly into contact with the hand of the cloth user during cleaning with the second side, thus not only leading to increased contamination of the protective clothing which protects the hand of the user during the decontamination operation, but additionally increasing the risk that the user comes directly into contact with the harmful substances or carries them along.

SUMMARY OF THE INVENTION

It is accordingly an object of the invention to provide a decontamination liquid spraying appliance which overcomes the above-mentioned disadvantages of the prior art devices of this general type, which is easy to operate and to handle and which makes it possible to apply a decontamination liquid in a short time over a large area in a focused manner.

With the foregoing and other objects in view there is provided, in accordance with the invention, a decontamination liquid spraying appliance. The appliance contains a storage container for receiving a decontamination liquid. The storage container is configured as a pressure container and has a threaded orifice. A spraying device is flow-connected to the storage container for decontaminating objects contaminated by harmful substances. The spraying device has an adapter head screwed in a pressure tight manner into the threaded orifice and a hand-actuated air pump carried by the adapter head. The hand-actuated air pump has a piston rod, a pump tube projecting into the storage container and a pump piston displaceable in the pump tube via the piston rod led through the adapter head for acting upon an interior of the pressure container with overpressure. The adapter head has a regulating valve for regulating a quantity of the decontamination liquid to be sprayed. A pouch is provided and has a top side with an orifice formed therein. The pouch accommodates the storage container with the spraying device such that the adapter head together with the regulating valve projects out of the pouch through the orifice on the top side.

In accordance with an added feature of the invention, a non-return valve is disposed at an end of the pump tube. The non-return valve prevents air conveyed into the pressure container by the air pump from flowing back into the pump tube.

In accordance with an additional feature of the invention, the adapter head has a liquid outlet and a riser tube is disposed on the adapter head. The riser tube extends into an interior of the pressure container as far as a bottom of the pressure container and through the riser tube the decontamination liquid is conveyed, in an event of overpressure in the pressure container, to the regulating valve and through the regulating valve to the liquid outlet formed on the adapter head.

In accordance with a further feature of the invention, an open/shut valve is provided. A spray nozzle is formed directly on the adapter head. The liquid outlet is connected to the spray nozzle and the spray nozzle is acted upon with the decontamination liquid through the open/shut valve.

In accordance with a further added feature of the invention, there is provided an open/shut valve, a spray nozzle, and a flexible hose having a first end connected to the liquid outlet and a second end connected to the spray nozzle. The spray nozzle is capable of being acted upon with decontamination liquid through the open/shut valve.

The liquid outlet is preferably configured such that the flexible hose extends toward a bottom of the pressure container.

In accordance with another added feature of the invention, the piston rod has a pull-and-push knob which, with the piston rod pushed in, lies substantially flat on a top side of the adapter head.

In accordance with another further feature of the invention, the pouch has holding elements such that the pouch can be carried as a belt pouch by a user of the decontamination liquid spraying appliance.

In accordance with a concomitant feature of the invention, the storage container is configured for receiving GD5 solution as the decontamination liquid.

Other features which are considered as characteristic for the invention are set forth in the appended claims.

Although the invention is illustrated and described herein as embodied in a decontamination liquid spraying appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The single FIGURE of the drawing is a diagrammatic illustration of a decontamination liquid spraying appliance according to the invention which is accommodated in a belt pouch.

DESCRIPTION OF THE PREFERRED EMBODIMENTS

Referring now to the single FIGURE of the drawing in detail, there is shown a decontamination liquid spraying appliance 1 according to the invention and contains a pressure container 2 in which decontamination liquid 4, in particular GD-5 decontamination solution, is located.

The decontamination liquid spraying appliance 1 according to the invention furthermore contains an adapter head 6 provided with an externally threaded portion 8 which can be screwed into an associated internally threaded orifice 10 on the top side of the pressure container 2. The configuration of the threads is in this case selected such that an overpressure of, for example, 6 bar or more can be built up and maintained within the pressure container 2.

To generate the overpressure, the adapter head 6 has provided on it an air pump 12 which contains a pump tube 14 which extends from the underside of the adapter head 6 into the interior of the pressure container 2 and in which a pump piston 16 can be moved up and down via a piston rod 18, in order to suck in air from outside and press it into the interior of the pressure container 2 at the lower end of the pump tube 14 by a nonreturn valve 20, shown only diagrammatically in the figure. For this purpose, the other end of the piston rod 18 is provided with a pull-and-push knob 22 which, with the pump piston 16 pushed in completely preferably lies on the top side of the adapter head 6. By the pump piston 16 being moved up and down by the pull-and-push knob 22, the user of the decontamination liquid spraying appliance 1 according to the invention can thus generate by hand, in the pressure container 2, an overpressure of approximately 6 bar which conveys the decontamination liquid 4 through a riser tube 24 fastened to the adapter head 6 to a regulating valve 26 arranged on the adapter head 6 and from a regulating valve 26, via a delivery line 28 formed in the adapter head 6, to a liquid outlet 30.

Via the regulating valve 26, for example a needle valve, indicated diagrammatically in the figure, the pressure and quantity of the decontamination liquid 4 supplied to the liquid outlet 30 can be regulated by hand.

As shown, furthermore, in the figure, the liquid outlet 30 is flow-connected to a flexible hose 32. At the other end of the flexible hose 32 is disposed a spray nozzle 34 which can be acted upon via a diagrammatically illustrated open/shut valve 36 with the decontamination liquid 4 in order to spray the latter through the spray nozzle 34. The flexible hose 32 in this case extends preferably downward away from the liquid outlet 30, so that the hose can easily be accommodated, rolled up, in the corresponding free inner region of a pouch 38 in which the appliance 1 according to the invention is preferably accommodated in such a way that the adapter head 6, together with the regulating valve 26 and the pull-and-push knob 22, projects out of an associated orifice 40 on the top side of the pouch 38. As a result, the user of the appliance can regulate the quantity of the decontamination liquid 4 and, if appropriate, increase the pressure in the pressure container 2 by the actuation of the air pump 12 via the pull-and-push knob 22.

The pouch 38 can be fastened to the trouser belt of a user preferably by holding loops, not illustrated in any more detail, or is provided with a hanging strap, so that the user, when using the appliance 1 according to the invention, can hang the pouch 38 over his shoulder. In this case, there may be provision, furthermore, for there to be provided, level with the first orifice 40, on the top side of the pouch a further orifice 42, through which the user can pull out the flexible hose 32 together with the spray nozzle 34 fastened to it, in order to spray the decontamination liquid 4 in a focused manner.

The decontamination liquid spraying appliance 1 according to the invention possesses the advantage that it has a highly compact and robust type of construction and, with an appropriate dimensioning of the pressure container 2, for example as a buffer-shaped container with a capacity of 1, 2 or 3 liters, can easily be carried as a belt pouch and can be extracted simply and quickly from the belt pouch for use or for filling. The compact type of construction likewise affords the advantage that the appliance can also be used in very confined spaces where it is not possible or is possible only with great difficulty to use larger appliances because of the lack of room.

Finally, in the preferred embodiment of the invention in which as wide an adapter head 6 as possible is employed, the pressure container 2 can be filled very easily and without loss through the threaded orifice 10 and can correspondingly also be emptied again and cleaned.

We claim:

1. A decontamination liquid spraying appliance, comprising:

a storage container for receiving a decontamination liquid, said storage container configured as a pressure container having a threaded orifice formed therein;

a spraying device flow-connected to said storage container for decontaminating objects contaminated by harmful substances, said spraying device having an adapter head screwed in a pressure tight manner into said threaded orifice and a hand-actuated air pump carried by said adapter head, said hand-actuated air pump having a piston rod, a pump tube projecting into said storage container and a pump piston displaceable in said pump tube via said piston rod led through said adapter head for acting upon an interior of said pressure container with overpressure, said adapter head having a regulating valve for regulating a quantity of the decontamination liquid to be sprayed; and a pouch having a top side with an orifice formed therein, said pouch accommodating said storage container with said spraying device such that said adapter head together with said regulating valve projects out of said pouch through said orifice on said top side.

2. The decontamination liquid spraying appliance according to claim 1, further comprising a non-return valve disposed at an end of said pump tube, said non-return valve preventing air conveyed into said pressure container by said air pump from flowing back into said pump tube.

3. The decontamination liquid spraying appliance according to claim 1, wherein said adapter head has a liquid outlet formed therein; and further comprising a riser tube disposed on said adapter head, said riser tube extending into an interior of said pressure container as far as a bottom of said pressure container and through said riser tube the decontamination liquid is conveyed, in an event of overpressure in said pressure container, to said regulating valve and through said regulating valve to said liquid outlet formed on said adapter head.

4. The decontamination liquid spraying appliance according to claim 3, further comprising:

an open/shut valve; and a spray nozzle communicating with said adapter head, said liquid outlet being connected to said spray nozzle and said spray nozzle being acted upon with the decontamination liquid through said open/shut valve.

5. The decontamination liquid spraying appliance according to claim 3, further comprising:

an open/shut valve;

a spray nozzle; and a flexible hose having a first end connected to said liquid outlet and a second end connected to said spray nozzle, said spray nozzle capable of being acted upon with decontamination liquid through said open/shut valve.

6. The decontamination liquid spraying appliance according to claim 5, wherein said liquid outlet is configured such that said flexible hose extends toward a bottom of said pressure container.

7. The decontamination liquid spraying appliance according to claim 1, wherein said piston rod has a pull-and-push knob which, with said piston rod pushed in, lies substantially flat on a top side of said adapter head.

8. The decontamination liquid spraying appliance according to claim 1, wherein said pouch has holding elements such that said pouch can be carried as a belt pouch by a user of the decontamination liquid spraying appliance.

9. The decontamination liquid spraying appliance according to claim 1, wherein said storage container is configured for receiving GD5 solution as the decontamination liquid.

* * * * *